US005686946A

United States Patent [19]

Mizutani

[11] Patent Number: 5,686,946

[45] Date of Patent: Nov. 11, 1997

[54] INK JET RECORDING DEVICE

[75] Inventor: Tsuyoshi Mizutani, Nagoya, Japan

[73] Assignee: Brother Kogyo Kabushiki Kaisha, Nagoya, Japan

[21] Appl. No.: 535,808

[22] Filed: Sep. 28, 1995

[30] Foreign Application Priority Data

Jan. 9, 1995 [JP] Japan ..... 7-001083

[51] Int. Cl.[6] ..... B41J 2/045

[52] U.S. Cl. ..... 347/68; 347/65; 347/70; 347/71; 347/72

[58] Field of Search ..... 347/68–72

[56] References Cited

FOREIGN PATENT DOCUMENTS 3-272856 12/1991 Japan .

*Primary Examiner*—Daniel P. Malley
*Attorney, Agent, or Firm*—Oliff & Berridge

[57] ABSTRACT

A first and second conductor layers are alternately laminated between first and second green sheets formed of piezoelectric ceramic powder, organic binder, plasticizer, etc. The first conductor layer is aligned with a lower end of the green sheet while the second conductor layer is aligned with an upper end of the green sheet. Therefore, the first conductor layers are exposed to the lower surface and connected to the driving electrodes. The second conductor layers are exposed to the upper surface and are connected to a common electrode. Grooves serving as ink channels are formed between the first and second conductor layers. Accordingly, the conductor layers are not exposed to the side surfaces of the ink channels. When a driving voltage is applied to a specific driving electrode of the actuator and the other driving electrodes and the common electrode are grounded, an electric field directed in the same direction as the polarizing direction occurs in the green sheet corresponding portion of the partition wall to which the driving voltage is applied. The partition wall expands by a piezoelectric longitudinal effect and the volume of the ink channel decreases. Through this operation, the ink in the ink channel is jetted from a nozzle.

18 Claims, 9 Drawing Sheets

INK JET RECORDING DEVICE

BACKGROUND OF THE INVENTION

1. Field of the Invention

The present invention relates to an ink jet recording device having plural nozzles, plural ink channels intercommunicating with the nozzles and partition walls. Each partition wall partitions respective ink channels and is formed in part from a piezoelectric ceramic material.

2. Description of Related Art

Non-impact type printing devices have recently greatly propagated in the market by replacing conventional impact type printing devices. Ink-ejecting type printing devices have been known to easily perform multi-gradation and coloration. In particular, a drop-on-demand type printing device for ejecting only ink droplets used for printing has rapidly propagated because of its excellent ejection efficiency and low running cost.

FIGS. 8 to 10 schematically show the construction of conventional ink jet recording heads as disclosed in Japanese Laid-open Patent Application No. Hei-3-272856. FIG. 8 is an exploded view showing a conventional ink jet recording head. FIG. 9 is a perspective view showing the ink jet recording head of FIG. 8 after fabrication and FIG. 10 is a front view of the conventional ink jet recording head of FIG. 9.

In FIG. 8, plural piezoelectric actuators 22 are secured to a substrate 21 to define grooves designed to have the same width through plural spacers 23. Thus, the piezoelectric actuators 22 are arranged at fixed intervals through the spacers. A cover plate 24 is secured on the piezoelectric actuators 22 and the spacers 23 to form ink channels 28. A nozzle plate 25 is secured to the front face of the substrate 21, each piezoelectric actuator 22 and the cover plate 24 to construct the ink jet recording head shown in FIG. 9.

The piezoelectric actuator 22 includes a piezoelectric ceramic green sheet and a conductive layer that are alternately laminated. A signal electrode 30A for applying a voltage is formed on one of the outer surfaces of the piezoelectric actuator 22. A grounded ground electrode 30B is formed on the other outer surface of the piezoelectric actuator 22.

As shown in FIG. 9, ink supplied from an ink supply port 26 is stocked in a manifold 27 provided inside the cover plate 24 and in each ink channel 28 formed between respective piezoelectric actuators 22. Upon actuation of the piezoelectric actuator 22, ink in the ink channel 28 is jetted from a nozzle 29 formed in the nozzle plate 25 intercommunicating with the ink channel 28.

As shown in FIGS. 10A and 10B, the substrate 21, the cover plate 24 and the piezoelectric actuators 22A and 22B constitute each ink channel 28A. When an ink jet driving voltage is applied to the piezoelectric actuators 22A and 22B, the piezoelectric actuators 22A and 22B expand as indicated by a broken line of FIGS. 10A and 10B. Thus the ink channel 28A is contracted, whereby the ink in the ink channel 28A is jetted from the nozzle 29A. At this time, the ink channels 28B and 28C adjacent to the ink channel 28A also contract by actuation of the piezoelectric actuators 22A and 22B. However, no ink is jetted in the ink channels 28B and 28C because only the piezoelectric actuators at one side of these channels is actuated.

However, since the signal electrodes 30A for deforming the piezoelectric actuators 22 are exposed to the ink channels 28, a short circuit occurs between another signal electrode 30A and the ground electrode 30B through the ink in the ink channel 28 when the high-voltage driving voltage V is applied to the signal electrode 30A so that some damage such as breaking of the electrode may occur on the surface of the ground electrode 30B. Therefore, it is necessary to form protection films on the signal electrodes 30A and the ground electrodes 30B in the ink channels 28 resulting in an increase in manufacturing cost.

SUMMARY OF THE INVENTION

It is an object of the present invention to provide an ink jet recording device having no protection films.

An ink jet recording device is provided having plural nozzles, plural ink channels intercommunicating with the nozzles and partition walls. Each partition wall partitions respective ink channels. At least a part of each partition wall is formed of a piezoelectric ceramic material having no electrode to which a driving voltage is applied. The ink jet recording device also has a first electrode provided inside each partition wall, a second electrode disposed in the partition wall to be substantially parallel to the first electrode and a voltage generating device that applies a driving voltage so that an electric field occurs between the first electrode and the second electrode.

An ink jet recording device may include a laminated piezoelectric ceramic member in which conductive members are disposed, plural grooves formed in a gap between each of the respective pairs of conductive members in a direction substantially perpendicular to a laminate direction of the laminated piezoelectric ceramic member. The recording device may further include partition walls formed simultaneously with formation of the grooves and containing a pair of conductive members, and a cover member covering the opening portions of the grooves.

When a driving voltage is applied from the voltage generating device to generate electric field between the first electrode and the second electrode, the partition wall deforms to jet ink from the ink channel.

As described above, according to the ink jet recording device of the present invention, no electrode is provided within the ink channel. The first and second electrodes to which the driving voltage generated from the voltage generating device is applied are provided inside the partition wall so the first and second electrodes can be prevented from contacting with the ink. Therefore, no protection film is required to be formed and no process and device of forming the protection film are required so that the manufacturing cost can be prevented from rising up.

Other objects, advantages and salient features of the invention will become apparent from the following detailed description taken in conjunction with the annexed drawings, which disclose preferred embodiments of the invention.

BRIEF DESCRIPTION OF THE DRAWINGS

Preferred embodiments of the present invention will be described in detail with reference to the following figures in which like reference numerals refer to like elements and wherein.

DETAILED DESCRIPTION OF PREFERRED EMBODIMENTS

Preferred embodiments of the present invention will be described below with reference to the accompanying drawings.

Figure 1:
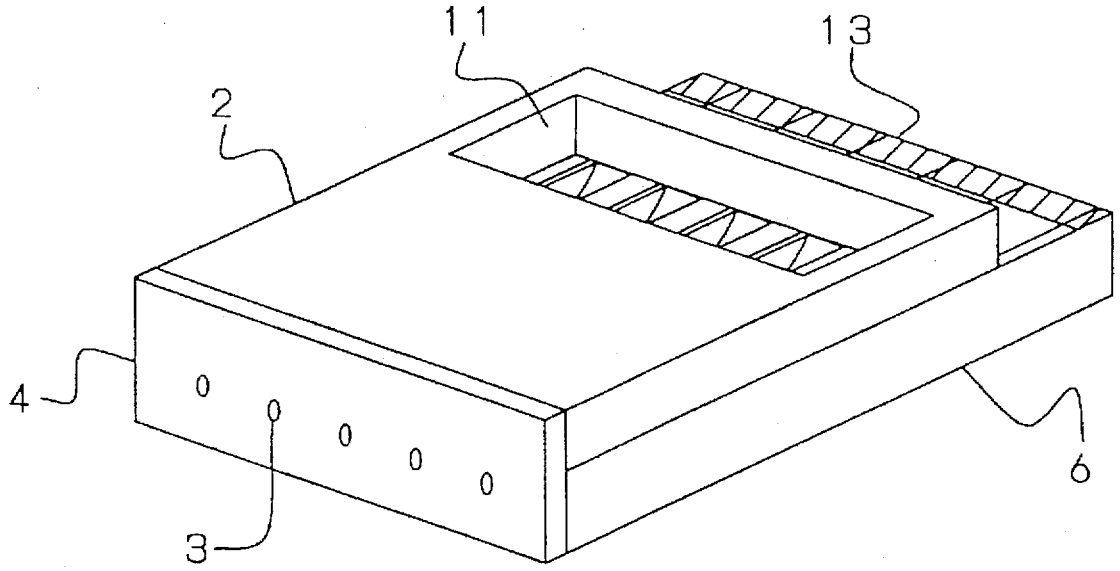
FIG. 1 is a perspective view showing the outline of an ink jet recording head of a first embodiment of the present invention.
Figure 6:
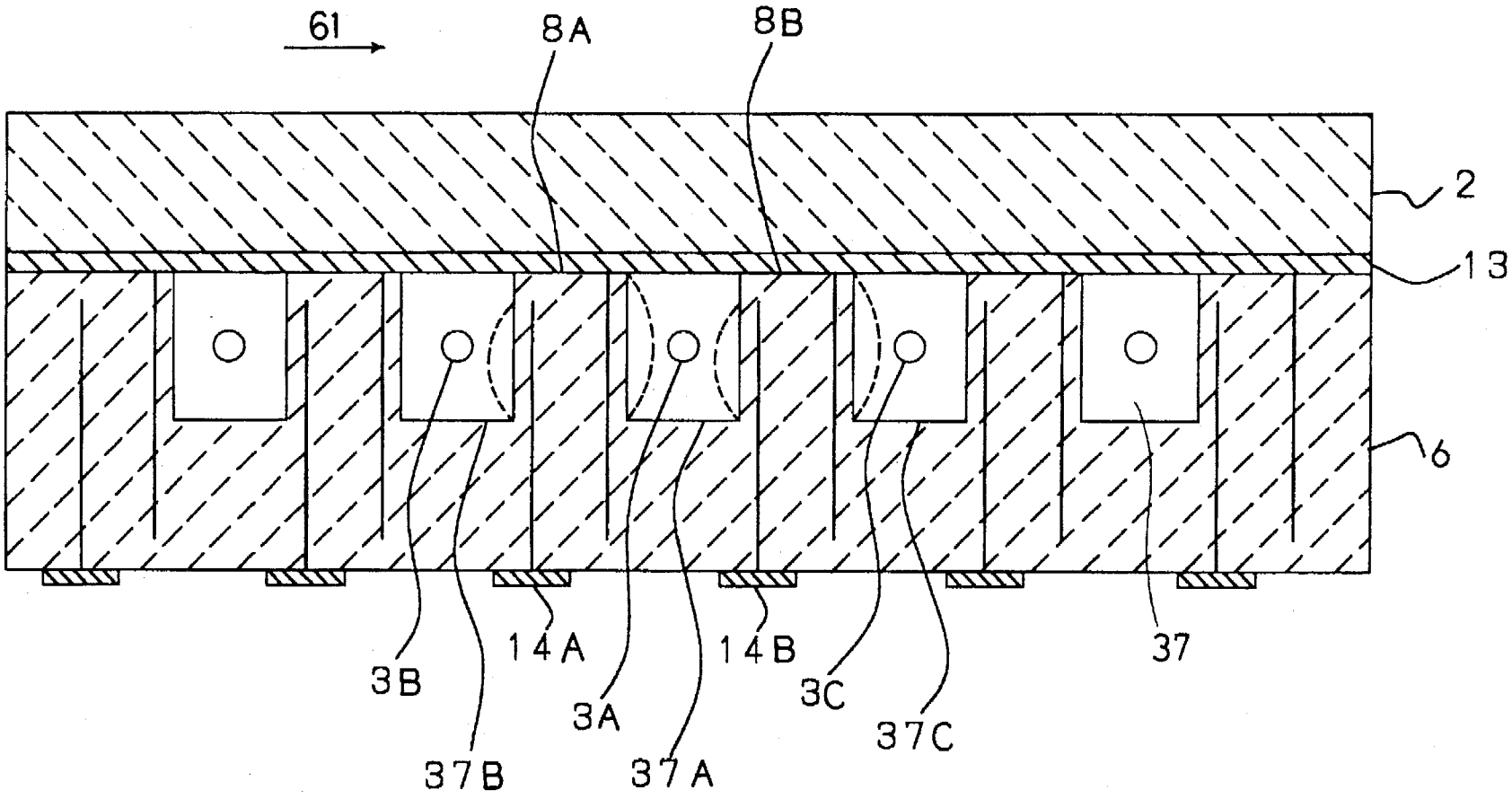
FIG. 6 is a diagram showing operation of the ink jet recording head for the first embodiment.

FIG. 1 is a perspective view showing an ink jet recording head. The ink jet recording head includes an actuator 6, a cover plate 2 and a nozzle plate 4. An ink supply port 11 is formed in the cover plate 2. Ink supplied from the ink supply port 11 is stocked in ink channels 37 (FIG. 6). When a driving voltage required for ink jetting is applied to driving electrodes (not shown), the ink channels 37 are compressed to jet the ink from nozzles 3 intercommunicating with the ink channels 37.

Figure 2:
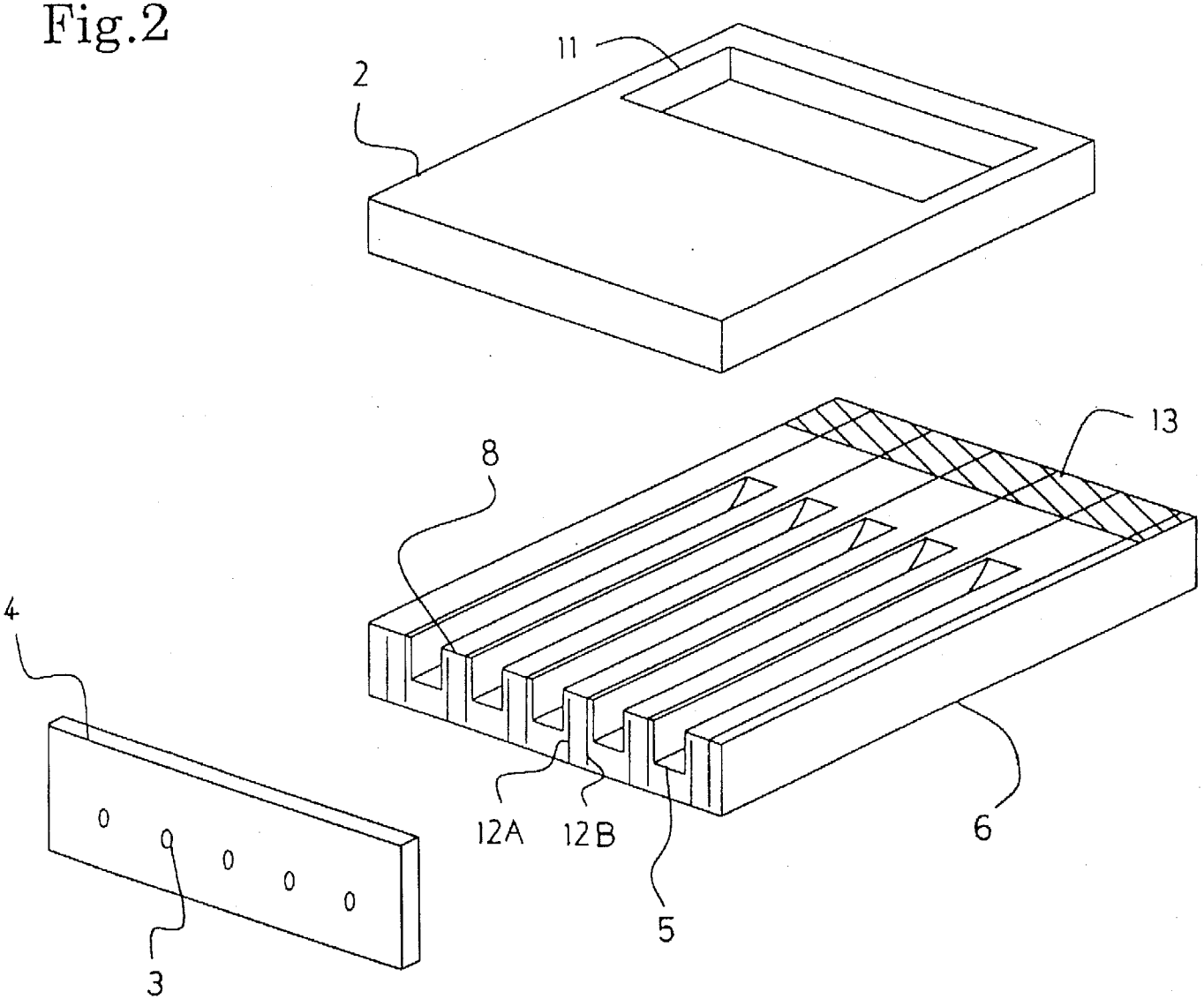
FIG. 2 is an exploded perspective view of the ink jet recording head of the first embodiment.

FIG. 2 is an exploded perspective view of the ink jet recording head shown in FIG. 1. The actuator 6 is a laminated piezoelectric element comprising plural piezoelectric members and plural conductor layers laminated on each other. Plural grooves 5 are formed in the actuator 6. Each groove 5 is formed between a conductor layer 12A serving as a first electrode (also called first activating member) and a conductor layer 12B serving as a second electrode (also called second activating member) in parallel with the conductor layer 12A. The cover plate 2 is formed of ceramic material and is joined to the groove-formed surface of the actuator 6 (the upper surface of the actuator 6 in FIG. 2) to cover the grooves 5. Thus, plural ink channels 37 (five ink channels in FIG. 2) are formed. As described above, the cover plate 2 is provided with the ink supply port 11 for supplying the ink. Ink stocked in an ink tank (not shown) is supplied through the ink supply port 11 into the ink channels 37.

The nozzle plate 4 is secured to the front face of the cover plate 2 and the actuator 6 to construct the ink jet recording head shown in FIG. 1. The nozzle plate 4 is provided with nozzles 3 designed to intercommunicate with the respective ink channels 37.

A method of manufacturing the actuator 6 will now be described with reference to FIGS. 3, 4 and 5.

Figure 3:
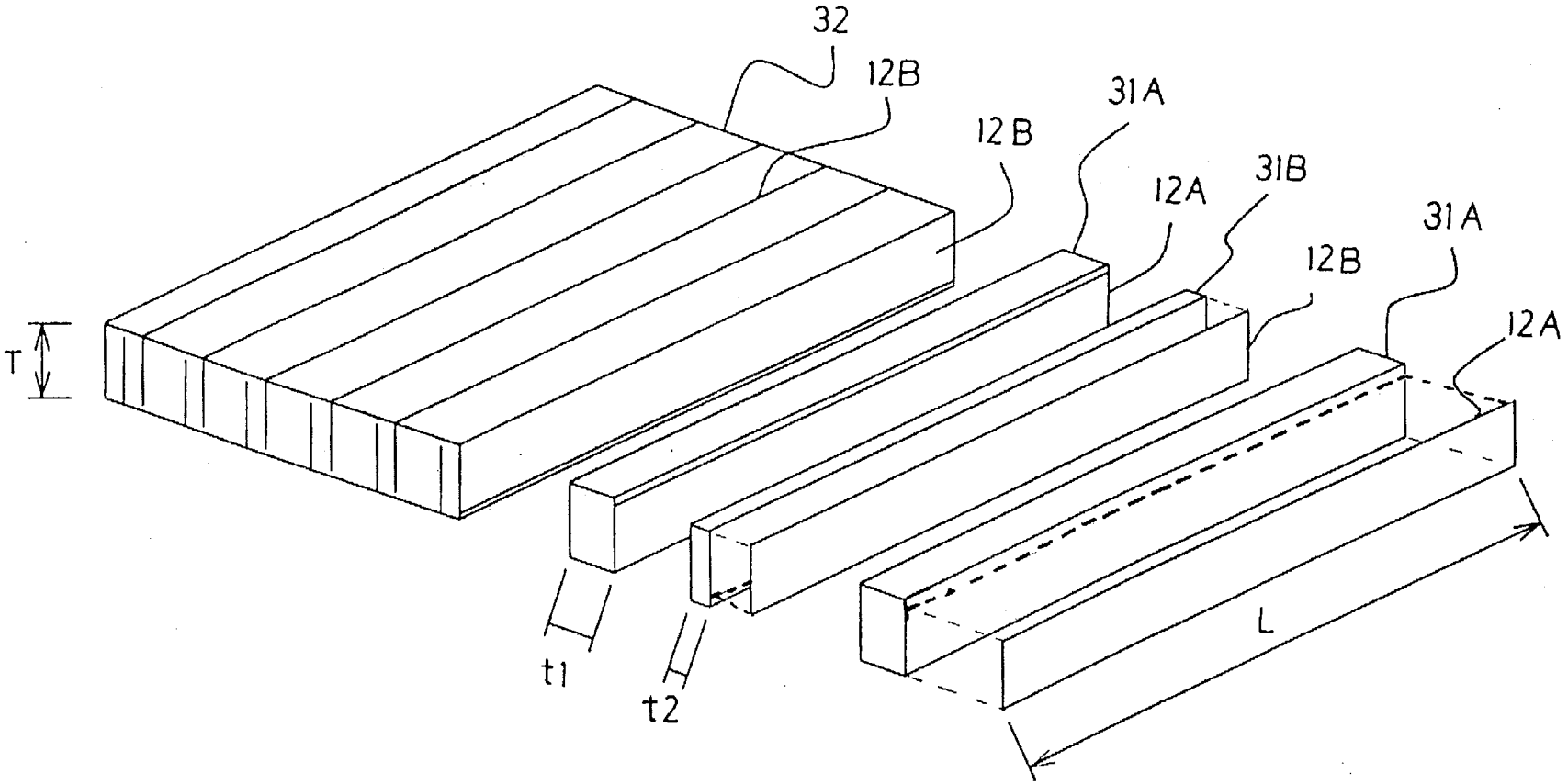
FIG. 3 is a perspective view showing a method of manufacturing a laminate member for the first embodiment.

In FIG. 3, the conductor layers 12A and 12B are alternately laminated between green sheets 31A and 31B formed of piezoelectric ceramic powder, organic binder, plasticizer, and the like. The conductive layers 12A and 12B are preferably different in thickness. For example, thickness t1 is 90 μm, thickness t2 is 50 μm, height T is 2 mm and length L. The length of the laminated body is equal to the lateral width of the actuator 6. That is, the conductor layer 12A is laminated at the right side of the green sheet 31A in FIG. 3. The green sheet 31B is laminated at the right side of the conductor layer 12A. The green sheet 31B is laminated at the right side of the conductor layer 12A. The conductor layer 12B is laminated at the right side of the green sheet 31B and the green sheet 31A is laminated at the right side of the conductor layer 12B. This lamination structure is repeated.

The conductor layers 12A and 12B are designed to have the same length L as the green sheets 31A and 31B. However, the layers 12A and 12B are designed to be slightly lower in height than the height T of the green sheets 31A and 31B. The conductor layer 12A is laminated on the right-side surface of the green sheet 31A in FIG. 3 to align with the lower end of the green sheet 31A. Furthermore, the conductor layer 12B is laminated on the right-side surface of the green sheet 31B to align with the upper end of the green sheet 31B. Lead zirconate titanate (PZT) may be used as a piezoelectric ceramic material of the green sheets 31A and 31B. The thickness of the green sheets 31A and 31B after sintering is set to satisfy the following inequalities: $t1>w1$, $t2<W2$, where t1 is the thickness of the green sheet 31A after sintering, t2 is the thickness of the green sheet 31B after sintering, w1 is the width of the groove 5 after sintering (FIG. 5) that serves as the ink channel 37 and w2 is the width of the partition wall 8 after sintering.

Subsequently, the laminate body 32 comprising the green sheets 31A and 31B and the conductor layers 12A and 12B is burned to be hardened. At this time, the conductor layer 12A is exposed to the lower surface of the laminate body 32 and the conductor layer 12B is exposed to the upper surface of the laminate body 32.

Figure 4:
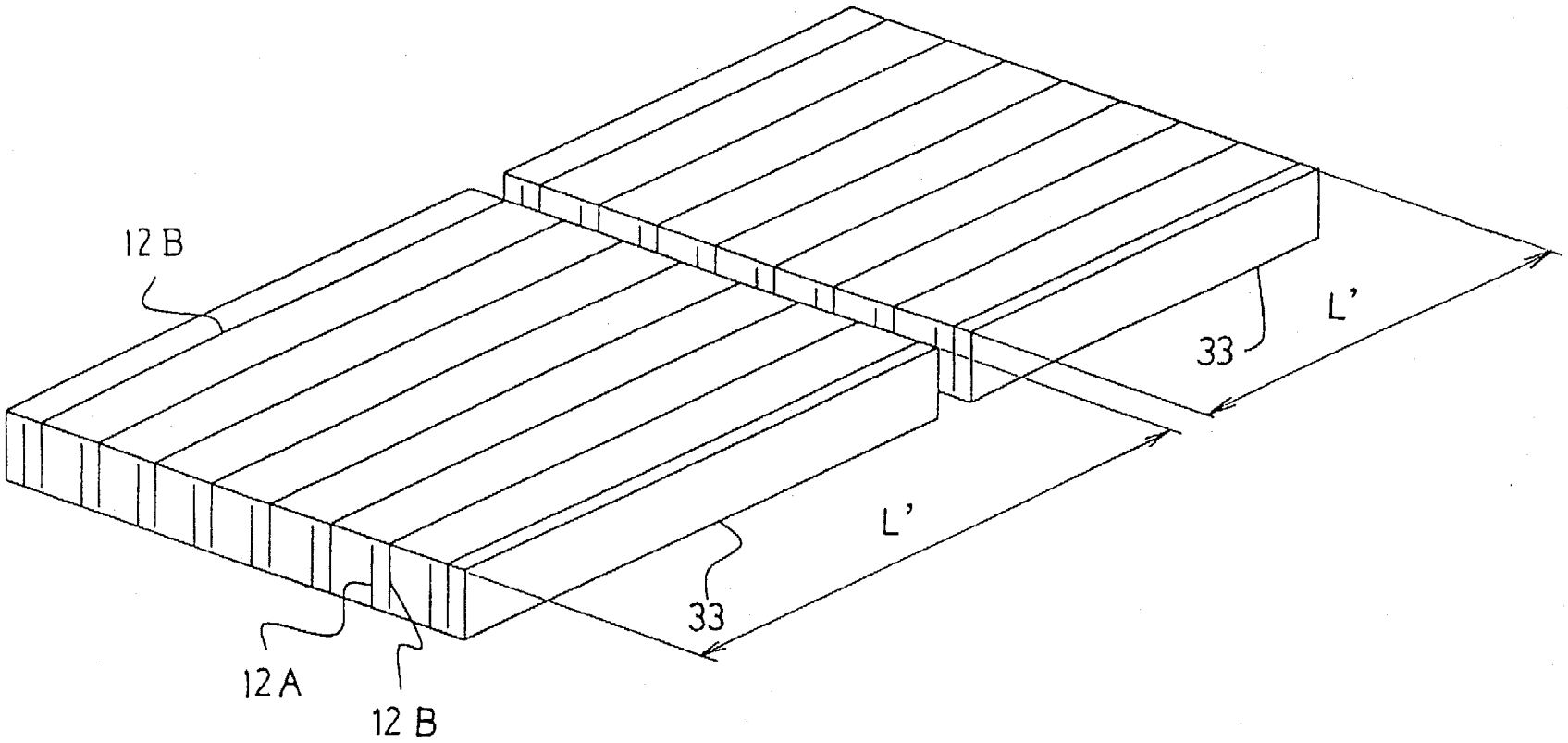
FIG. 4 is a diagram showing a method of manufacturing a laminate plate for the first embodiment.

The laminate body 32 is cut perpendicularly to the laminate face of the laminate body 32 using a cutting device such as a dicing saw to form laminate plates having a length L' (for example, 10 mm) as shown in FIG. 4.

Figure 5A:
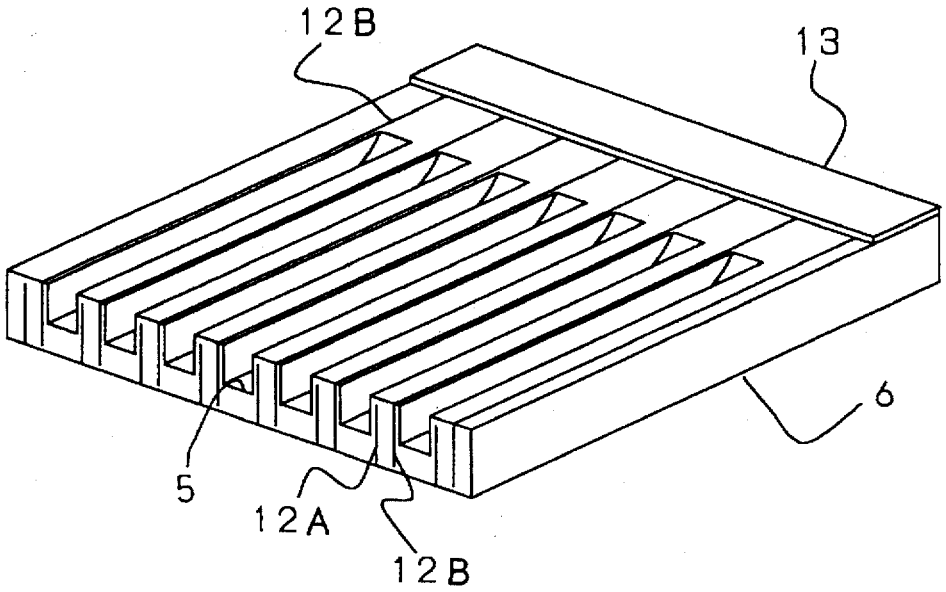
FIG. 5A is a perspective view showing an actuator for the first embodiment.
Figure 5B:
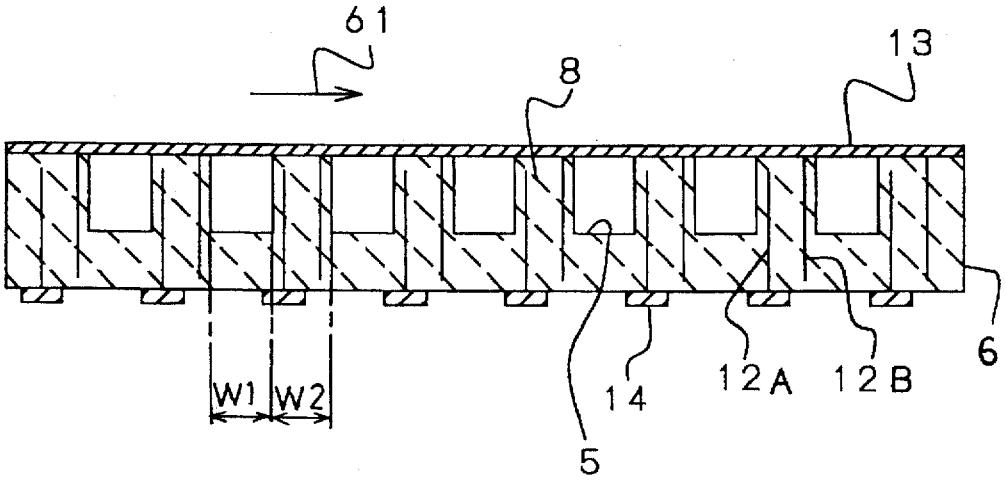
FIG. 5B is a cross-sectional view showing the actuator for the first embodiment.

Subsequently, the grooves 5 having the width w are formed using a cutting device such as a dicing saw to extend from the upper surface of the laminate plate 33 to which the conductor layers 12B are exposed until a middle portion of the laminate plate 33 as shown in FIG. 5A. With this cutting operation, the partition walls 8 are formed in the laminate plate 33 and the conductor layers 12A and 12B are disposed inside each partition wall 8. Subsequently, the actuator 6 is subjected to an electroless plating treatment or the like so that a common electrode 13 through which all the conductor layers 12B are commonly connected to one another is formed on the upper surface of the laminate plate 33. Driving electrodes 14 are independently isolated from one another in an islandish form and are formed on the lower surface of the actuator 6 to be conducted to the corresponding conductor layers 12A.

After the actuator 6 is formed as described above, the common electrode 13 and each driving electrode 14 are connected to a driving circuit (not shown) through a flexible board (not shown). The common electrode 13 is grounded and a high voltage is applied to each driving electrode 14 to perform a polarizing treatment to polarize the portions of the partition walls 8 formed in the actuator 6 that correspond to the green sheets 31B in a direction as indicated by an arrow 61 in FIG. 5B.

Thereafter, the cover plate 2 is joined to the face of the actuator 6 on which the grooves 5 are formed and the nozzle plate 4 is joined to the front face of the actuator 6.

Other variations and embodiments are also within the scope of this invention. For example, the green sheets 31A and 31B may include a resin layer and a piezoelectric layer. Then, grooves 5 may extend into only the piezoelectric layer but not into the resin layer. In yet another embodiment, the common electrode 13 may be positioned between the resin layer and the piezoelectric layer. In this embodiment, the cover plate 2 could be placed on the opposite side of the resin layer as the common electrode 13. Then, the conductor layers 12A and 12B would be within the piezoelectric layer and the grooves 5 could be formed in the resin layer from the cover plate 2 through the common electrode 13 and into the piezoelectric layer. Of course other variations are also well known to those skilled in the art.

The operation of the ink jet recording head will now be described.

When a driving voltage V is applied to the driving electrodes 14A and 14B of the actuator 6 by the driving circuit (not shown) and the other driving electrodes 14 and the common electrode 13 are grounded as shown in FIG. 6, an electric field directed in the same direction as the polarization direction as indicated by the arrow 61 occurs in the portions of the partition walls 8A and 8B corresponding to the green sheets 31B. With this electric field, the partition walls 8A and 8B expand as indicated by the broken lines in FIG. 6 due to a piezoelectric longitudinal effect. Therefore, the volume of an ink channel 37A is contracted and the ink in the ink channel 37A is jetted from a nozzle 3A.

When the partition wall 8A is actuated, both side surfaces of the partition wall 8A expand so the ink channels 37A and 37B adjacent to the partition wall 8A also expanded at the same time. However, only the partition 8A or 8B at one side is deformed in the ink channels 37A and 37B so no ink is jetted from these ink channels.

In this case, every other dummy channel in which no ink is filled may be formed in the actuator to prevent the neighboring ink channels from being contracted.

As described above, in the ink jet recording head of this embodiment, an electrode to which a voltage is applied is not provided on the inner surface of the ink channel 37. Rather, the conductor layers 12A and 12B to which a driving voltage is applied are provided inside the partition wall 8. Therefore, the conductor layers 12A and 12B do not contact the ink. Therefore, the conductor layers 12A and 12B are prevented from being short-circuited to each other through the ink so it is unnecessary to form a protection film for protecting the conductor layers against the ink. Accordingly, no process or device for forming a protection film is required. Thus, the manufacturing cost can be prevented from rising up.

Figure 7A:
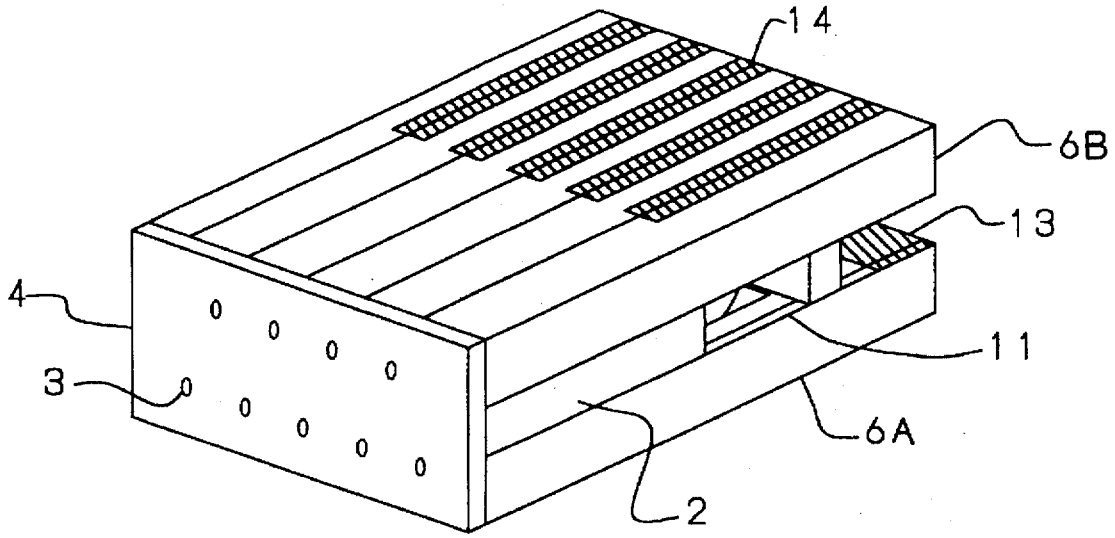
FIG. 7A is a perspective view showing an ink jet recording head of a second embodiment of the present invention.
Figure 7B:
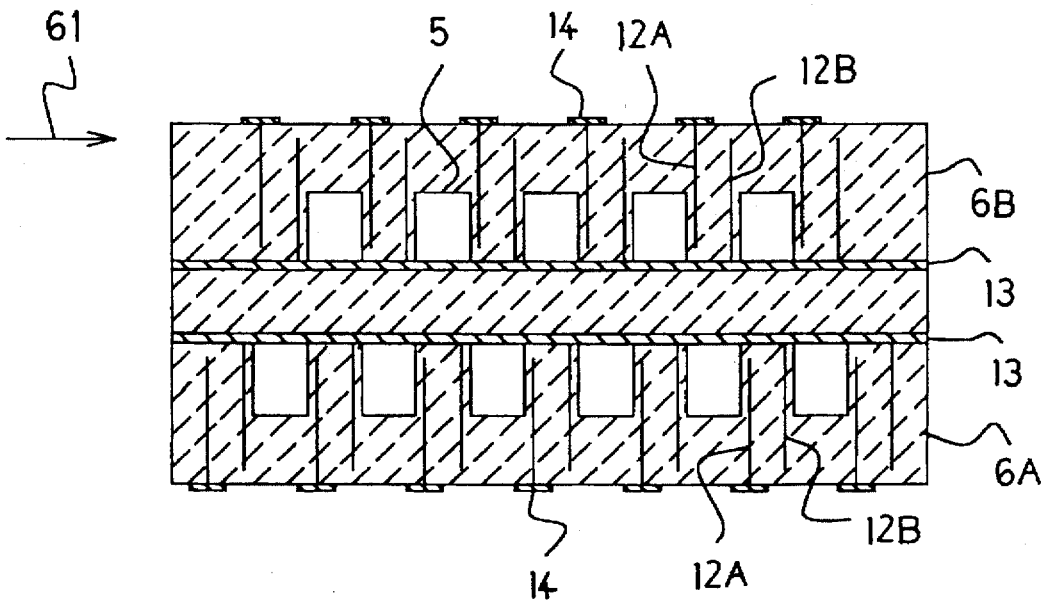
FIG. 7B is a cross-sectional view showing the ink jet recording head of the second embodiment.
Figure 8:
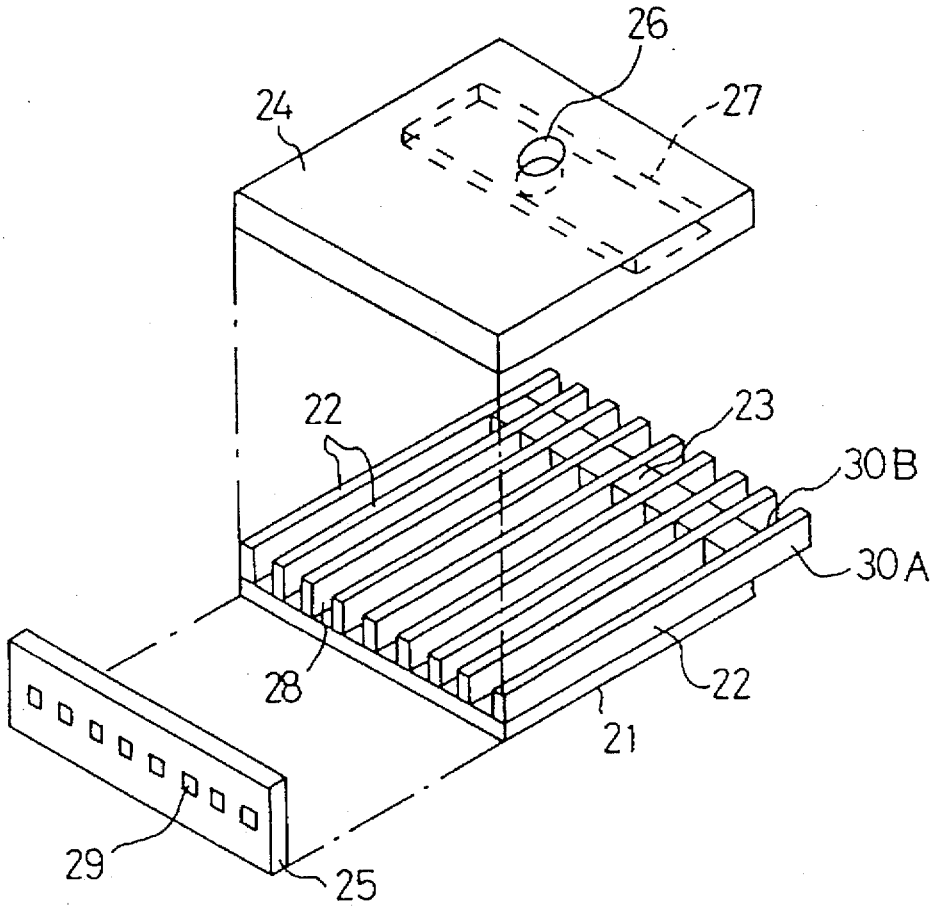
Fig.8 RELATED ART
FIG. 8 is an exploded perspective view showing a conventional ink jet recording head.
Figure 9:
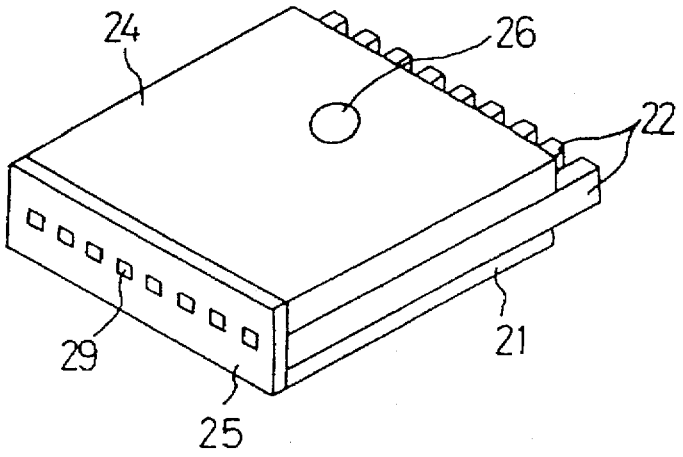
Fig.9 RELATED ART
FIG. 9 is a perspective view showing the conventional ink jet recording head.
Figure 10A:
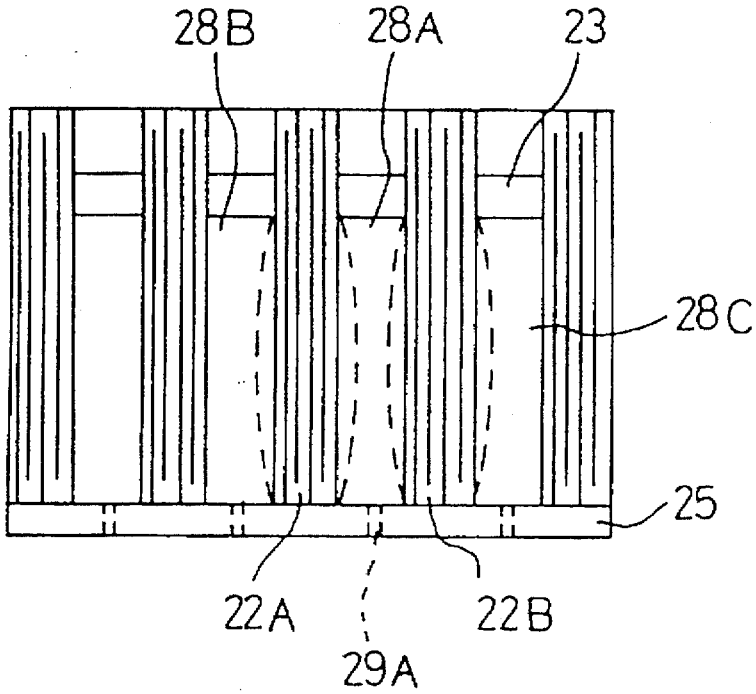
Fig.10A RELATED ART
FIG. 10A is a diagram showing the operation of the conventional ink jet recording head.
Figure 10B:
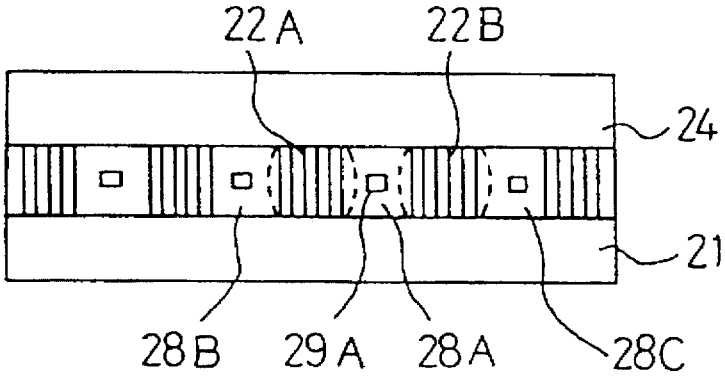
Fig.10B RELATED ART
FIG. 10B is a diagram showing the operation of the conventional ink jet recording head.

FIGS. 7A and 7B show another embodiment of the ink jet recording head. In this embodiment, two actuators 6A and 6B are joined to each other through the cover plate 2 so the respective grooves thereof are confronted to each other as shown in FIG. 7B. This method can provide an ink jet recording device that is capable of performing a print operation with higher print density.

While the invention has been described in relation to preferred embodiments, many modifications and variations are apparent from the description of the invention. All such modifications and variations are intended to be within the scope of the present invention as defined in the appended claims.

What is claimed is:

1. An ink jet device, comprising:

plural nozzles;

plural ink channels intercommunicating with said nozzles;

partition walls partitioning the plural ink channels, at least a part of each partition wall being formed of a piezoelectric ceramic material;

a first activating member located within at least one partition wall;

a second activating member located within said at least one partition wall, said second activating member being substantially parallel to said first activating member; and a voltage generating device that generates an electric field between said first activating member and said second activating member.

2. The ink jet device of claim 1, wherein the piezoelectric ceramic material is lead zirconate titanate.

3. The ink jet device of claim 1, further comprising a cover member covering said plural ink channels and said partition walls.

4. The ink jet device of claim 1, further comprising a driving electrode connected to said first activating member.

5. The ink jet device of claim 4, wherein said voltage generating device applies a driving voltage to said driving electrode to generate the electric field.

6. The ink jet device of claim 5, further comprising a common electrode connected to said second activating member.

7. The ink jet device of claim 6, wherein the common electrode and said second activating member are grounded.

8. The ink jet device of claim 1, wherein the at least one partition wall expands when the voltage generating device generates the electric field between said first activating member and said second activating member.

9. The ink jet device of claim 1, wherein said first activating member and said second activating member do not contact ink located within said ink channels.

10. An ink jet device comprising:

a plurality of channels;

a plurality of nozzles corresponding to said plurality of channels;

a plurality of partition walls, each channel being separated from one another by one of said partition walls;

a plurality of first electrodes, each first electrode being located within a separate one of said partition walls;

a plurality of second electrodes, each second electrode being located within a separate one of said partition walls; and a voltage generating device connecting to said first electrodes and said second electrodes, said voltage generating device actuating selected electrodes to eject ink from corresponding channels.

11. The ink jet device of claim 10, wherein the voltage generating device includes a plurality of driving electrodes each connecting with one of said first electrodes and a common electrode connecting with each said second electrode.

12. The ink jet device of claim 11, wherein the voltage generating device applies a voltage to select driving electrodes to actuate the selected electrodes and eject the ink from the corresponding channels.

13. The ink jet device of claim 11, wherein said common electrode is grounded.

14. The ink jet device of claim 10, wherein when said voltage generating device actuates said selected electrodes, corresponding partition walls expand to eject ink from the corresponding channels.

15. A method of fabricating an ink jet device, the method comprising the steps of:

forming an alternating laminate structure having layers of a first conductive layer, a piezoelectric ceramic layer and a second conductive layer; and forming grooves and partition walls in said laminate structure such that each partition wall includes the first conductive layer, the piezoelectric ceramic layer and the second conductive layer, each groove formed between separate partition walls.

16. The method of claim 15, wherein each groove extends from a first surface of said laminate structure to a middle portion of the laminate structure.

17. The method of claim 15, further comprising the step of connecting a common electrode to the second conductive layer after forming said grooves and said partition walls.

18. The method of claim 15, further comprising the step of connecting driving electrodes to said laminate structure such that each driving electrode connects to one of said first conductive layers.

* * * * *